US006932125B2

(12) United States Patent
Stanley

(10) Patent No.: US 6,932,125 B2
(45) Date of Patent: Aug. 23, 2005

(54) HELIUM BALLOON KIT

(76) Inventor: Virgil E. Stanley, 5860 N. Michigan Rd., Indianapolis, IN (US) 46228

( * ) Notice: Subject to any disclaimer, the term of this patent is extended or adjusted under 35 U.S.C. 154(b) by 42 days.

(21) Appl. No.: 10/434,023

(22) Filed: May 8, 2003

(65) Prior Publication Data

US 2005/0098227 A1 May 12, 2005

(51) Int. Cl.[7] ..... B65D 55/00
(52) U.S. Cl. ..... 141/114; 141/313; 222/5
(58) Field of Search ..... 141/114, 329, 330, 141/313–317; 222/5, 81–83.5

(56) References Cited

U.S. PATENT DOCUMENTS

| | | | | |
|---|---|---|---|---|
| 1,702,974 A | | 2/1929 | MacDonald | |
| 2,646,019 A | | 7/1953 | Chetlan | |
| 2,862,531 A | | 12/1958 | Walker | |
| 3,174,145 A | | 3/1965 | Busch | |
| 3,310,024 A | * | 3/1967 | McConnell | 116/210 |
| 3,796,181 A | | 3/1974 | Collins | |
| 3,881,531 A | | 5/1975 | Rossi | |
| 4,034,501 A | | 7/1977 | Zeyra | |
| 4,094,347 A | | 6/1978 | Ikemoto | |
| 4,167,204 A | | 9/1979 | Zeyra | |
| 4,516,199 A | | 5/1985 | Frieder et al. | |
| 4,586,456 A | | 5/1986 | Forward | |
| 4,629,436 A | * | 12/1986 | Stewart et al. | 441/93 |
| 4,681,138 A | | 7/1987 | Giuliani | |
| 4,815,677 A | * | 3/1989 | Rushing et al. | 244/33 |
| 4,857,029 A | | 8/1989 | Dierick et al. | |
| 4,901,664 A | | 2/1990 | Labrecque | |
| 4,903,958 A | | 2/1990 | DiCarlo et al. | |
| 4,911,674 A | | 3/1990 | Cole | |
| 5,049,106 A | | 9/1991 | Kim et al. | |
| 5,108,337 A | | 4/1992 | Sloan et al. | |
| 5,188,558 A | | 2/1993 | Barton et al. | |
| 5,234,726 A | | 8/1993 | Dahan | |
| 5,306,194 A | | 4/1994 | Epstein | |
| 5,334,072 A | | 8/1994 | Epstein | |
| 5,399,122 A | | 3/1995 | Slater | |
| 5,496,203 A | | 3/1996 | Murray | |
| 5,499,941 A | | 3/1996 | Penjuke, Sr. | |
| 5,573,437 A | * | 11/1996 | Van Dyke et al. | 446/75 |
| 5,893,790 A | | 4/1999 | Montgomery | |

(Continued)

*Primary Examiner*—J. Casimer Jacyna
(74) *Attorney, Agent, or Firm*—Coats & Bennett, P.L.L.C.

(57) ABSTRACT

The present invention relates to a balloon kit that provides one or more balloons, a cylinder filled with a compressed gas, such as helium, and a conduit adapted to connect to the cylinder. The cylinder comprises an ORMD cylinder that may be mailed or transported and used at any convenient time. When connected to the cylinder, the conduit punctures the cylinder and dispenses the helium into a balloon. After the balloon is inflated, the open end of the balloon is sealed to contain the helium in the balloon. The balloon kit may also include ribbons and/or weights to attach to the balloons and/or a card to present to a recipient along with the balloons. The conduit may comprise an external nozzle or an internal conduit disposed in an open end of a balloon. Exemplary cylinders include two sections threadably coupled to form a cylinder for holding the helium.

33 Claims, 6 Drawing Sheets

U.S. PATENT DOCUMENTS 6,158,588 A * 12/2000 Conti ..... 206/457
6,302,171 B1 10/2001 Watts
6,439,950 B1 8/2002 Goldman et al.
6,488,557 B1 12/2002 Elliott et al.

* cited by examiner

HELIUM BALLOON KIT

BACKGROUND OF THE INVENTION

Novelty balloons are widely used to celebrate various special occasions, such as birthdays, anniversaries, Valentine's Day, Mother's Day, Father's Day, baby showers, wedding showers, etc. Inflated novelty balloons can be purchased from any number of vendors, including grocery stores, discount stores, and specialty stores. The purchased balloons are then transported to the intended recipient.

Conventional methods for acquiring and transporting inflated novelty balloons have many disadvantages. Because balloons deflate over time, inflated novelty balloons are generally purchased the day of a special occasion and hand delivered to an intended location. Consumers may be too busy to make a special trip for a novelty balloon on that special day, making such last minute purchases inconvenient. In addition, transporting inflated balloons to an intended destination is often difficult. Weather conditions, i.e., wind, may make it difficult to control the inflated balloons. The buoyancy of the novelty balloons, due to the helium used to inflate the balloons, may also reduce window and/or mirror visibility in an automobile. Further, if a recipient lives in another city or state, it is impractical to hand deliver a novelty balloon. Because consumers cannot currently purchase a balloon kit with a helium cylinder that can be legally mailed within the United States, such long-distance consumers have few options.

To address these difficulties, many specialty stores offer delivery service, for a fee, to deliver one or more inflated balloons to a desired location on a particular day. Because such services are expensive and often require significant advanced planning, this solution is not always attractive to a thrifty and/or busy consumer.

Therefore, there is a need for a balloon kit packaged in a small package that provides a portable helium source for inflating one or more balloons at a convenient time and/or location.

SUMMARY OF THE INVENTION

The present invention relates to a balloon kit that provides one or more balloons, a cylinder filled with a compressed gas, such as helium, and a conduit adapted to couple to the cylinder. When connected to the cylinder, the conduit punctures the cylinder and dispenses helium into a balloon. After the balloon is inflated, the open end of the balloon is sealed to contain the helium in the balloon. An exemplary cylinder includes two sections threadably coupled to form a cylinder for holding the helium.

DETAILED DESCRIPTION OF THE INVENTION

Figure 1:
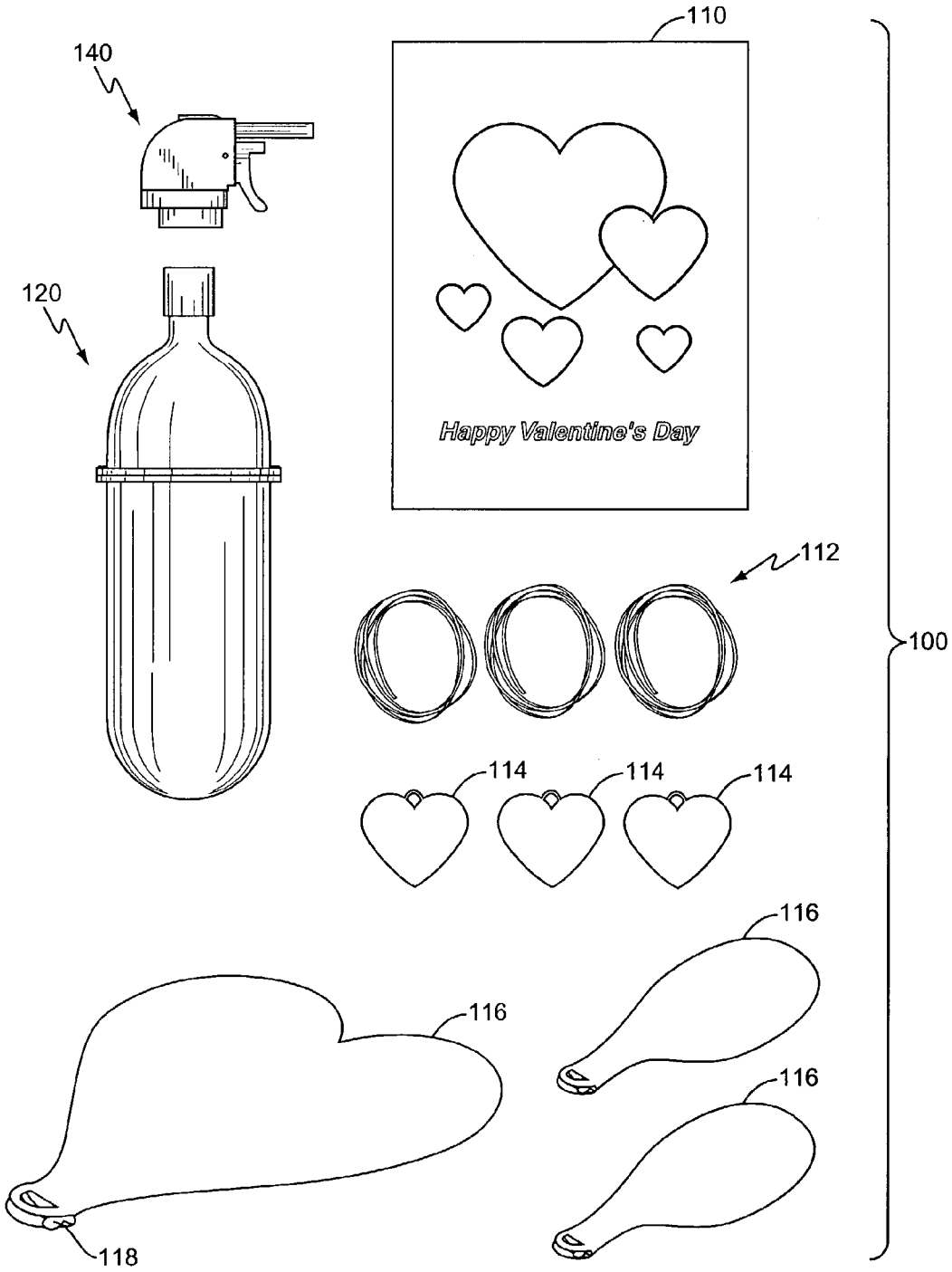
FIG. 1 illustrates the components of an exemplary balloon kit.

FIG. 1 illustrates an exemplary balloon kit 100 according to the present invention. Balloon kit 100 may include an occasion specific card 110, i.e., a Valentine's Day card, multiple strands of ribbon 112, balloon weights 114, balloons 116, a cylinder 120 for holding a compressed gas, such as helium, and a conduit, such as nozzle 140. Balloons 116 may be selected from a wide variety of balloons, such as mylar balloons, latex balloons, or balloons made from plastic or poly-vinyl chloride (PVC) materials. Further, balloons 116 may include an adhesive portion 118 for sealing balloon 116 after balloon 116 is inflated.

While the embodiment illustrated in FIG. 1 focuses on a balloon kit with a Valentine's Day theme, those skilled in the art will appreciate that balloon kit 100 may be produced for a wide variety of themes, such as birthdays, anniversaries, Mother's Day, Father's Day, baby showers, wedding showers, etc. Further, while the balloon kit 100 illustrated in FIG. 1 shows a specific number of components, it will be understood that balloon kit 100 may include any number of balloons 116, weights 114, ribbons 112, cards 110, cylinders 120, and nozzles 140. Those skilled in the art will also appreciate that other embodiments of the present invention may exclude any occasion specific cards 110, ribbons 112, and/or weights 114.

Referring to FIG. 1, cylinder 120 may be made of any rigid, non-permeable material, i.e., aluminum, steel, fiberglass or poly-carbonate. Cylinder 120 may also be manufactured and assembled to meet the Department of Transportation's Other Regulated Materials-D (ORMD) regulations. By meeting the ORMD regulations for high-pressure gasses, cylinder 120 is exempt from hazardous goods shipment requirements and may be mailed anywhere in the United States. Exemplary embodiments of cylinder 120 include a body capable of holding $\leqq 7.2$ in$^3$ of a compressed gas, such as helium. These cylinders 120 may typically fill 1–5 balloons with helium. While the description contained herein refers to helium, those skilled in the art will appreciate that cylinder 120 of the present invention may hold any known compressed gas. As used herein, "cylinder" means any container capable of holding a gas.

Figure 2:
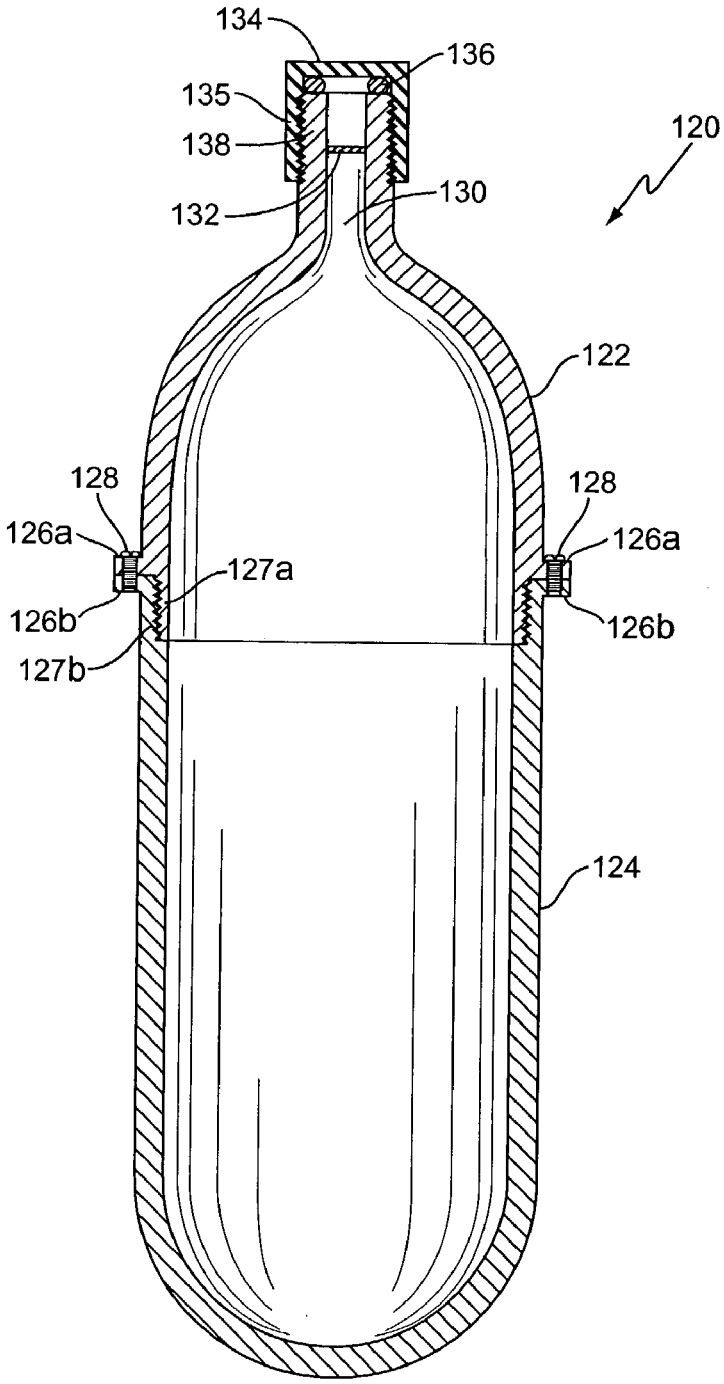
FIG. 2 illustrates a cross-section of an exemplary cylinder.

When constructed from materials, such as aluminum or steel, the body of cylinder 120 may be manufactured as a single piece. However, when constructed from materials such as steel, poly-carbonate, and the like, the body of cylinder 120 may be manufactured in two separate sections and later assembled to form a complete cylinder 120. FIG. 2 illustrates an exemplary cross-section of a two-piece cylinder 120. Cylinder 120 comprises a top section 122 and a bottom section 124. Top section 122 includes multiple screw fittings disposed in an outer rim or flange 126*a* proximate top connecting threads 127*a*, while bottom section 124 includes corresponding screw fittings disposed in a corresponding outer rim or flange 126*b* proximate bottom connecting threads 127*b*. Top section 122 further includes a neck 130 with coupling threads 138 or snaps (not shown) around a perimeter of the neck 130. Typically, neck 130 is significantly narrower than the body of cylinder 120. Sufficiently narrow necks regulate the speed at which helium is dispensed, and therefore, eliminate the need for a separate regulator. Exemplary cylinder necks 130 may have an inner diameter of approximately 3 mm or less.

A two-piece cylinder 120 is assembled by threadably coupling top connecting threads 127*a* with bottom connecting threads 127*b*. The coupling junction between top section 122 and bottom section 124 may also be fused with ultrasonic heat, welding, and/or industrial glue. Coupling screws 128 disposed in the plurality of screw fittings in outer rims 126*a*, 126*b* may provide further strength and stability to the coupling junction.

Cylinder 120 in balloon kit 100 contains a predetermined amount of helium. A non-permeable seal 132 positioned in the neck of cylinder 120 confines the helium to cylinder 120. An optional cap 134 threadably coupled to threads 138 around the perimeter of neck 130 helps protect seal 132 during packaging and shipping. Further, an optional O-ring 136 disposed between cap 134 and the top of neck 130 provides additional protection from possible leaks around seal 132.

Figure 3:
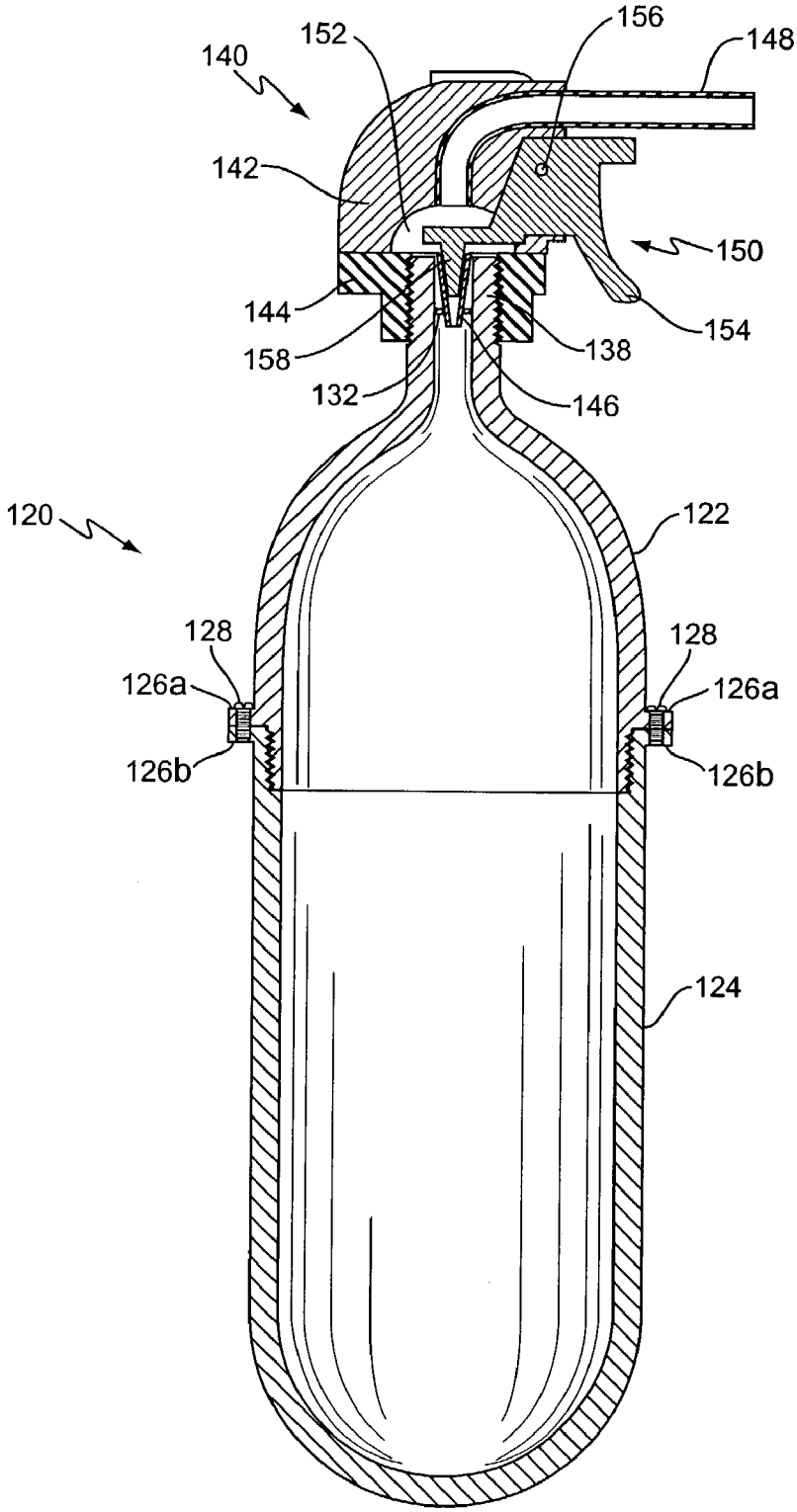
FIG. 3 illustrates a cross-section of an exemplary cylinder and conduit.

A consumer removes cap 134 when ready to inflate a balloon 116 from balloon kit 100. After removing cap 134 from cylinder 120, a conduit for dispensing the helium from cylinder 120 into balloon 116 is threadably coupled to neck 130. FIG. 3 illustrates an exemplary nozzle 140 that functions as a conduit. Nozzle 140 includes an upper body 142, a threaded base 144, a hollow puncture pin 146, an outlet, such as an elongated pipe 148, and a valve 150. When threaded base 144 is threadably coupled to threads 138 of neck 130, puncture pin 146 pierces the seal 132 disposed in neck 130.

Valve 150 may be used to regulate the transfer of the helium from cylinder 120 to elongated pipe 148. Valve 150 includes a trigger 154 rotatably mounted to upper body 142 by a pivot pin 156 and nominally biased to a closed position as shown in FIG. 3. Valve 150 also includes a flow-regulating pin 158 that normally seals the hollow opening of puncture pin 146 to contain the helium in the cylinder 120. Valve 150 remains in this closed position until a user rotates trigger 154 about pivot pin 156 by pulling trigger 154 towards threaded base 144. Rotating trigger 154 about pivot pin 156 removes flow-regulating pin 158 from the hollow opening of puncture pin 146, releasing the helium from cylinder 120 into an open area 152 of upper body 142. Nozzle 140 then funnels the helium from open area 152 into elongated pipe 148.

Figure 4A:
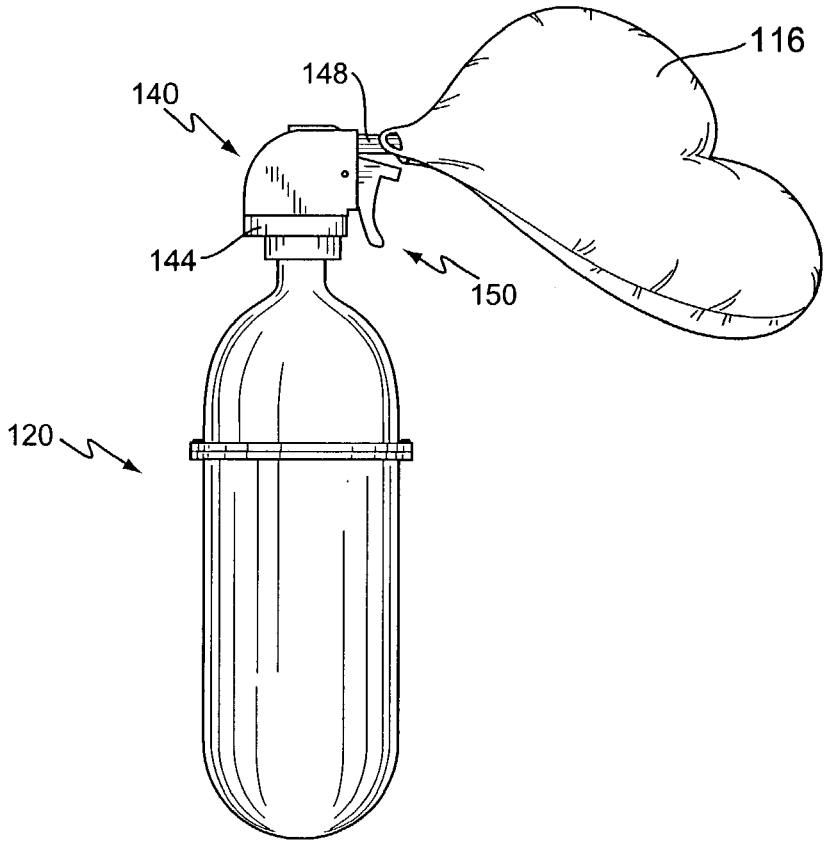
FIG. 4A illustrates an exemplary cylinder and conduit inflating a balloon from the balloon kit of FIG. 1.

As shown in FIG. 4A, a balloon 116 attached to elongated pipe 148 is inflated when valve 150 is manipulated to dispense helium into balloon 116 via elongated pipe 148. Once balloon 116 has been inflated with helium, the open end of balloon 116 is removed from nozzle 140 and sealed according to any method known in the art, such as with adhesive tape 118, to confine the helium within balloon 116. Because valve 150 regulates the amount of helium dispensed from nozzle 140, those skilled in the art will recognize that cylinder 120 with nozzle 140 may be used to fill a plurality of balloons. Those skilled in the art will also appreciate that the present invention is not limited to the external nozzle 140 shown in FIGS. 1, 3, and 4A. Other external nozzles well known in the art are also applicable to the present invention.

Figure 4B:
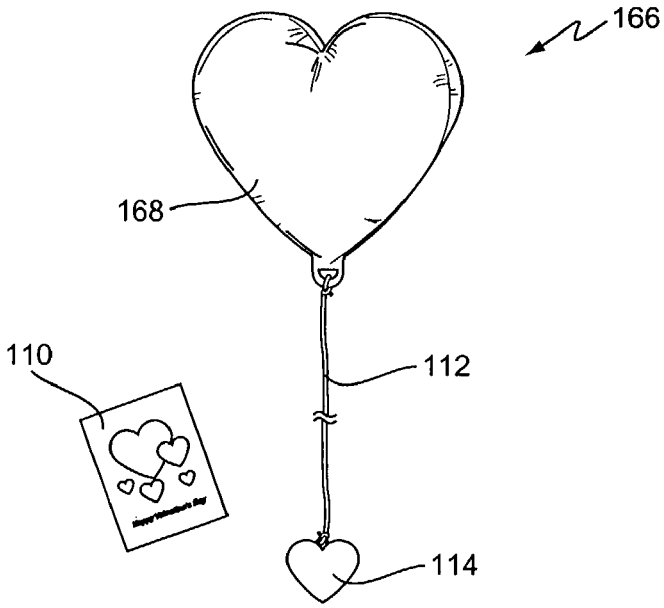
FIG. 4B illustrates a card and an inflated balloon from the exemplary balloon kit of FIG. 1.

FIG. 4B illustrates an exemplary balloon product 166 of balloon kit 100. Ribbon 112 is attached to inflated balloon 168 to provide a handle for the inflated balloon 168. Attaching weight 114 to ribbon 112 prevents inflated balloon 168 from floating away when unattended. Balloon product 166, along with card 110, is then ready for the intended recipient.

Figure 5:
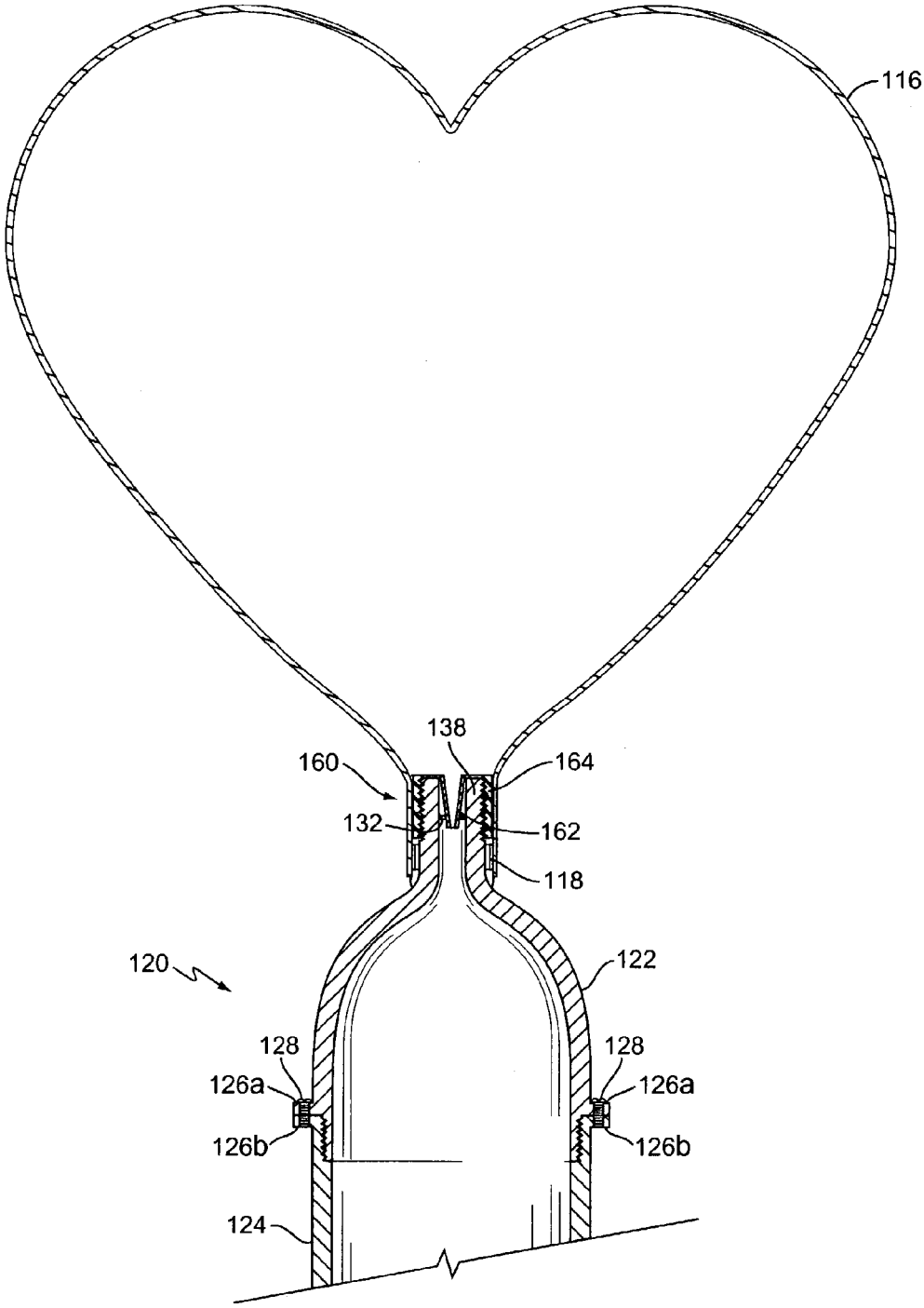
FIG. 5 illustrates another exemplary cylinder and conduit inflating a balloon.

FIG. 5 illustrates another exemplary embodiment of the present invention. In the embodiment of FIG. 5, conduit 160 is included in an open neck section of balloon 116. Conduit 160 includes a hollow puncture pin 162 and a threaded section 164. Threadably coupling the threaded section 164 to the threads 138 disposed on the neck of cylinder 120 causes puncture pin 162 to pierce seal 132. As a result, helium dispensed from cylinder 120 into balloon 116 via conduit 160 inflates balloon 116. Because the embodiment of FIG. 5 does not include a valve to stop the flow of the helium, the cylinder of FIG. 5 may only fill one balloon. Once filled with helium, the open end of inflated balloon 168 is removed from cylinder 120 and sealed to retain the helium within inflated balloon 168. Further, as shown in FIG. 4B, ribbon 112 and/or weight 114 may be attached to inflated balloon 168.

Figure 6:
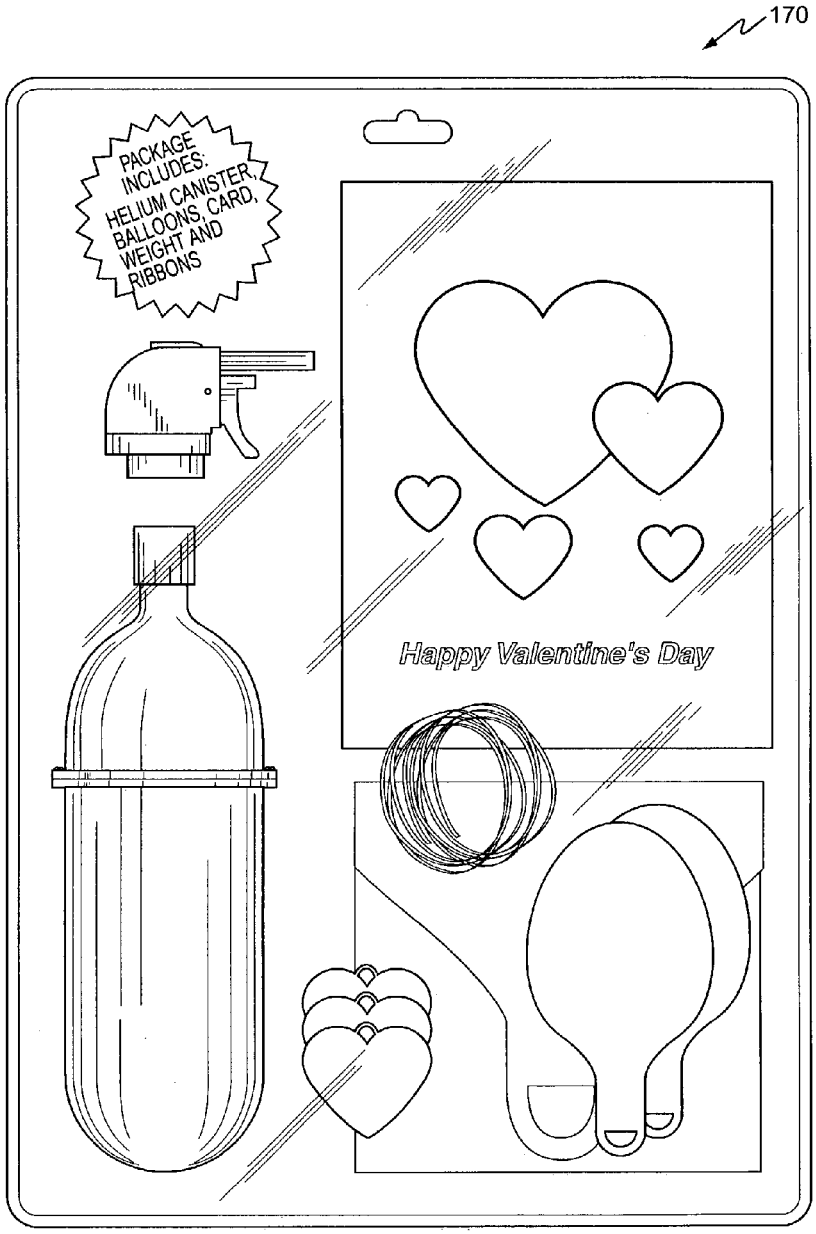
FIG. 6 illustrates an exemplary packaged balloon kit.

The invention described above provides a balloon kit 100 that contains materials, including a compressed gas source contained in an ORMD cylinder, for producing one or more inflated novelty balloons. Balloon kit 100 may be packaged according to any packaging technique well known in the art. FIG. 6 illustrates an exemplary packaged balloon kit 170. As shown in FIG. 6, package 170 encases the elements of an exemplary balloon kit in a clear plastic mold that may be hung from a rack in a wide variety of stores, such as hardware stores, discount stores, grocery stores, etc. Those skilled in the art, however, will appreciate that the kit described above is not limited to the packaging shown in FIG. 6.

The above described balloon kit provides several advantages over current novelty balloon products. For example, the packaged balloon kit may be purchased in advance and transported to an intended destination without the hassles corresponding to the transportation of inflated balloons. Further, a consumer may ship a packaged balloon kit to an intended recipient via U.S. mail or Air Freight without worrying about special hazardous materials regulations. Once the balloon kit arrives at the intended destination, the balloons may be inflated at any convenient time.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced herein.

What is claimed is:

1. A balloon kit comprising:

at least one balloon;

a cylinder containing helium, said cylinder comprising a coupling portion;

a conduit for dispensing said helium from said cylinder to said balloon, said conduit comprising:

a body;

a coupler to fasten said conduit body to said coupling portion of said cylinder;

a puncture pin disposed within said conduit body for puncturing said cylinder as said coupler of said conduit is fastened to said coupling portion of said cylinder; and an outlet for dispersing said helium into said balloon.

2. The balloon kit of claim 1 wherein said conduit is disposed in an open end of said balloon.

3. The balloon kit of claim 1 wherein said conduit comprises a nozzle adapted to regulate the flow of said helium into said balloon responsive to user control.

4. The balloon kit of claim 3 wherein said outlet comprises an elongated pipe for dispensing said helium into said balloon.

5. The balloon kit of claim 3 wherein said nozzle comprises a valve adapted to selectively open or seal said cylinder responsive to said user control.

6. The balloon kit of claim 1 further comprising at least one ribbon for each balloon.

7. The balloon kit of claim 6 further comprising at least one weight to attach to each ribbon.

8. The balloon kit of claim 1 further comprising at least one occasion appropriate card.

9. The balloon kit of claim 8 wherein said occasion appropriate card is a Valentine's Day card, a birthday card, an anniversary card, a Mother's Day card, or a Father's Day card.

10. The balloon kit of claim 1 wherein each balloon is made of a flexible material.

11. The balloon kit of claim 10 wherein said flexible material is mylar, latex, plastic, or poly-vinyl chloride (PVC).

12. The balloon kit of claim 1 wherein said cylinder is made of a rigid, non-permeable material.

13. The balloon kit of claim 12 wherein said rigid, non-permeable material is poly-carbonate, steel, fiberglass, or aluminum.

14. The balloon kit of claim 1 wherein said coupling portion of said cylinder comprises a threaded portion on a neck of said cylinder.

15. The balloon kit of claim 1 wherein said coupling portion of said cylinder comprises a snap portion on a neck of said cylinder.

16. The balloon kit of claim 1 wherein said cylinder comprises at least two sections threadably coupled together.

17. The balloon kit of claim 16 wherein each of said sections of said cylinder include threads and wherein the two sections can be threadably coupled via said threads of said two sections.

18. The balloon kit of claim 16 wherein each section of said cylinder includes an open-end portion and wherein said open-end portions are threadably coupled to form said cylinder.

19. The balloon kit of claim 1 wherein said coupling portion comprises an internal opening having a diameter less than 3 mm.

20. The balloon kit of claim 1 wherein said cylinder comprises a high-pressure ORMD cylinder.

21. The balloon kit of claim 1 wherein the at least one balloon includes sealing means for sealing an open end of the balloon after said helium is dispersed into said balloon.

22. The balloon kit of claim 21 wherein the sealing means comprises a substantially non-permeable adhesive.

23. A method for inflating a balloon with a balloon kit, the method comprising:

connecting an open end of said balloon to a cylinder containing a compressed gas via a conduit adapted to fasten to said cylinder;

puncturing said cylinder with a puncture pin disposed in said conduit while fastening said conduit to said cylinder; and inflating said balloon by dispersing said compressed gas from said cylinder into said open end of said balloon via said conduit.

24. The method of claim 23 wherein said conduit is disposed in said open end of said balloon and wherein connecting said open end of said balloon to said cylinder comprises threadably connecting said conduit to said cylinder.

25. The method of claim 23 wherein said conduit is disposed in said open end of said balloon and wherein connecting said open end of said balloon to said cylinder comprises snapping said conduit to said cylinder.

26. The method of claim 23 wherein said conduit comprises a nozzle with an elongated outlet pipe, and wherein connecting said open end of said balloon to said cylinder comprises coupling said nozzle to said cylinder via one of a threaded connection or a snap connection and inserting said elongated outlet pipe into said open end of said balloon.

27. The method of claim 26 further comprising regulating the flow of said compressed gas into said open end of said balloon with a valve control associated with said nozzle.

28. The method of claim 23 wherein dispersing said compressed gas from said cylinder into said open end of said balloon comprises selectively manipulating a nozzle to selectively open or seal said cylinder responsive to user control.

29. The method of claim 23 further comprising sealing said open end of the inflated balloon.

30. The method of claim 29 wherein sealing said inflated balloon comprises sealing said open end of said balloon with a substantially non-permeable adhesive.

31. The method of claim 29 further comprising tying a ribbon to said sealed end of said inflated balloon.

32. The method of claim 31 further comprising attaching a weight to said ribbon.

33. The method of claim 23 wherein said compressed gas comprises helium.

* * * * *